US007735769B2

(12) United States Patent
Thiel et al.

(10) Patent No.: US 7,735,769 B2
(45) Date of Patent: Jun. 15, 2010

(54) AUTOMATED SLEEVE FILLING FOR WINDING SHAFTS ON ROLL SLITTING AND WINDING MACHINES

(75) Inventors: Ulrich Thiel, Nümbrecht (DE); Werner Müller, Wiehl-Brächen (DE)

(73) Assignee: Kampf Schneid- und Wickeltechnik GmbH & Co. KG, Wiehl (DE)

( * ) Notice: Subject to any disclaimer, the term of this patent is extended or adjusted under 35 U.S.C. 154(b) by 0 days.

(21) Appl. No.: 12/199,788

(22) Filed: Aug. 27, 2008

(65) Prior Publication Data

US 2009/0057475 A1 Mar. 5, 2009

(30) Foreign Application Priority Data

Aug. 27, 2007 (DE) ..... 10 2007 040 643

(51) Int. Cl.
*B65H 19/22* (2006.01)

(52) U.S. Cl. ..... 242/533; 242/533.1; 242/533.7

(58) Field of Classification Search ..... 242/533, 242/533.1, 533.7, 578, 578.2
See application file for complete search history.

(56) References Cited

U.S. PATENT DOCUMENTS 2,840,320 A * 6/1958 Csutor ..... 242/533.1
3,424,398 A * 1/1969 Bellevue ..... 242/533.7
3,718,302 A * 2/1973 Mount et al. ..... 242/533.3
3,733,035 A * 5/1973 Schott, Jr. ..... 242/527.3
4,208,019 A * 6/1980 Dusenbery ..... 242/527.2
4,236,626 A * 12/1980 Noe ..... 198/468.6
4,391,415 A * 7/1983 Hollier, Jr. ..... 242/533
5,941,474 A * 8/1999 Cushing ..... 242/533.1
6,269,859 B1 * 8/2001 Semba ..... 156/457
6,966,521 B2 * 11/2005 White ..... 242/533.7

FOREIGN PATENT DOCUMENTS

DE 101 55 133 A1 5/2003

* cited by examiner

*Primary Examiner*—Sang Kim
(74) *Attorney, Agent, or Firm*—Muncy, Geissler, Olds & Lowe, PLLC

(57) ABSTRACT

A method for automatic sleeve filling of a winding shaft on roll cutting and winding machines is provided in which, in an exemplified embodiment, in a first step at least two empty winding sleeves are slid onto a free end of a winding shaft so that the winding sleeves are adjacent to one another, in a second step the last winding sleeve slid on by a freely positionable fork piece of a freely programmable draw-off plate along the winding shaft is slid over the winding shaft until the last winding sleeve has reached a predetermined position, in a third step the next-to-last winding sleeve slid on is grasped by tongs freely positionable along the winding shaft and is slid over the winding shaft to the point where in a fourth step the fork piece can dip into the gap produced by the tongs so that the next-to-last winding sleeve is positionable along the winding shaft by the fork piece.

7 Claims, 4 Drawing Sheets

AUTOMATED SLEEVE FILLING FOR WINDING SHAFTS ON ROLL SLITTING AND WINDING MACHINES

This nonprovisional application claims priority under 35 U.S.C. §119(a) to German Patent Application No. DE 102007040643.8, which was filed in Germany on Aug. 27, 2007, and which is herein incorporated by reference.

BACKGROUND OF THE INVENTION

1. Field of the Invention

The present invention relates to a process for automated sleeve filling of a winding shaft on roll slitting and winding machines.

2. Description of the Background Art

Roll slitting and winding machines are often equipped with two winding shafts, sometimes even more, on which winding sleeves are placed, corresponding to the width of the longitudinally slit strips. Often these winding sleeves are fastened onto friction rings that are supported by the winding shaft, moving with somewhat of a lead. This lead serves to compensate for length and diameter tolerances of the winding rolls. The fastening of the sleeves on the friction rings usually takes place, as in the case of free-wheeling, by clamping elements that are activated via the torque. In the case of a standstill or slight backward rotation the empty winding sleeve can easily move axially and be positioned at the correct location corresponding to the predetermined slit widths of the strips to be slit.

Various processes and devices are known for filling the winding shafts. Two different ways for filling the winding shafts will be described in the following. It is assumed for the description that follows that in the case of roll and sleeve refilling in the stopped state, the winding shafts are solidly supported on one side, usually the drive side, and a support bearing at the other end of the winding shaft is moved away from the winding shaft to such a distance that a floating state of the winding roll develops; this pertains to the device in accordance with the invention as well as the process. A floating state is achieved, for example, when a support bearing or another bearing is removed from one end of the winding shaft so that the end of the winding shaft hangs free in the air. Thus the finished wound rolls can be slid off and the empty sleeves slid on.

In a first example the sliding off of the wound roll is accomplished manually onto a supporting belt or a supporting shaft adjacent to the winding shaft, from which the wound rolls are later removed individually. If the wound rolls are very heavy, moving them off by hand can take a great deal of effort. In such a case, so-called draw-off plates are provided on the machines; these are supported on guides that run parallel to the winding shafts and are movable by motors over threaded spindles, chains or other conveyer devices. Draw-off plates is the name given to apparatus which can be moved inward in the area of the winding roll and by means of which the winding sleeves and/or the finished wound rolls can be moved away over the winding shaft. During the winding process these plates are parked on the drive side in the free space between an outermost material edge and the machine frame. The plates are provided with a horseshoe-shaped fork piece which surrounds the respective winding shaft closely but does not make contact. In this way it is possible to ensure that the draw-off force of the plate is exerted not only against the end surface of the winding roll but also or exclusively against the end face of the winding sleeve. Telescoping, i.e., displacement of the wound strip relative to the sleeve of the winding roll due to pressing by the draw-off plate is thus avoided.

In an additional example for applying the winding sleeve, each winding sleeve individually and successively is put in place manually and slid with suitable measurement methods, for example a measurement slider or a ruler, to the winding position. Numerous auxiliary devices are customary for recognizing the correct position: from a hand-marked line through an applied ruler or a measuring tape that can be pulled out, as described in DE 101 55 133 A1, wherein the measuring tape can also be designed with digital indication of the position, all the way to laser light dots—various methods are known and conventionally employed.

The drawbacks of these procedures are obvious, since these operating modes are not economical; they can only be justified when the number of rolls per winding, which is also called a lifter, is not too large; and the poor economy point is about 12 rolls and two winding shafts.

In the case of small slit widths, generally linked with a larger number of winding rolls, the use of so-called core boxes is usual. Core boxes are groove-shaped half shells with semicircular chambers in which the empty winding sleeves are placed. As a result of the chambers, the sleeves are positioned at an exact right angle to the axis of rotation. The chamber distance also corresponds exactly to the slit width. Often the core boxes are also provided with upper half shells (half boxes) that can be moved into and out of position, so that the empty winding sleeves are supported and secured all around. These core boxes with inserted sleeves are carried manually or by devices and shoved onto each winding shaft over a free end. Now all winding sleeves have the correct distance from one another. After opening the upper half box, the lower core box is first removed radially and then axially from the winding range. The solution using core boxes is operationally reliable. However, each slit width requires a core box made specifically for it. Thus core boxes mainly come under consideration only for standard widths, for example in the case of adhesive tape rolls.

SUMMARY OF THE INVENTION

It is therefore an object of the present invention to provide a financially advantageous technical solution for sliding winding sleeves onto the winding shafts automatically and in the shortest possible time and positioning them there.

The process of the invention has now created the possibility of moving the winding sleeves fully automatically onto the winding shaft and positioning them accurately. In this process, the winding sleeve can be moved with tongs far enough away from the other winding sleeves slid onto the winding shaft such that a fork piece of the draw-off plate can move between adjacent sleeves. The fork piece moves over the winding shaft and enters a position in which, immediately above the winding shaft, it opposes a front end of the winding sleeve such that the winding sleeve can be slid over the winding shaft. The fork piece has the shape of a two-tined fork, wherein during the positioning of the winding shaft, the fork piece passes between the two tines of the fork and the tines and/or the U-shaped rounded area of the fork is/are immediately adjacent to the winding sleeve. The tongs are fastened to the draw-off plate and likewise are adjustable against the winding shaft, specifically are adjustable against the winding shaft to such a point that the grippers of the tongs are able to grasp the winding sleeve, hold it and slide it over the winding shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
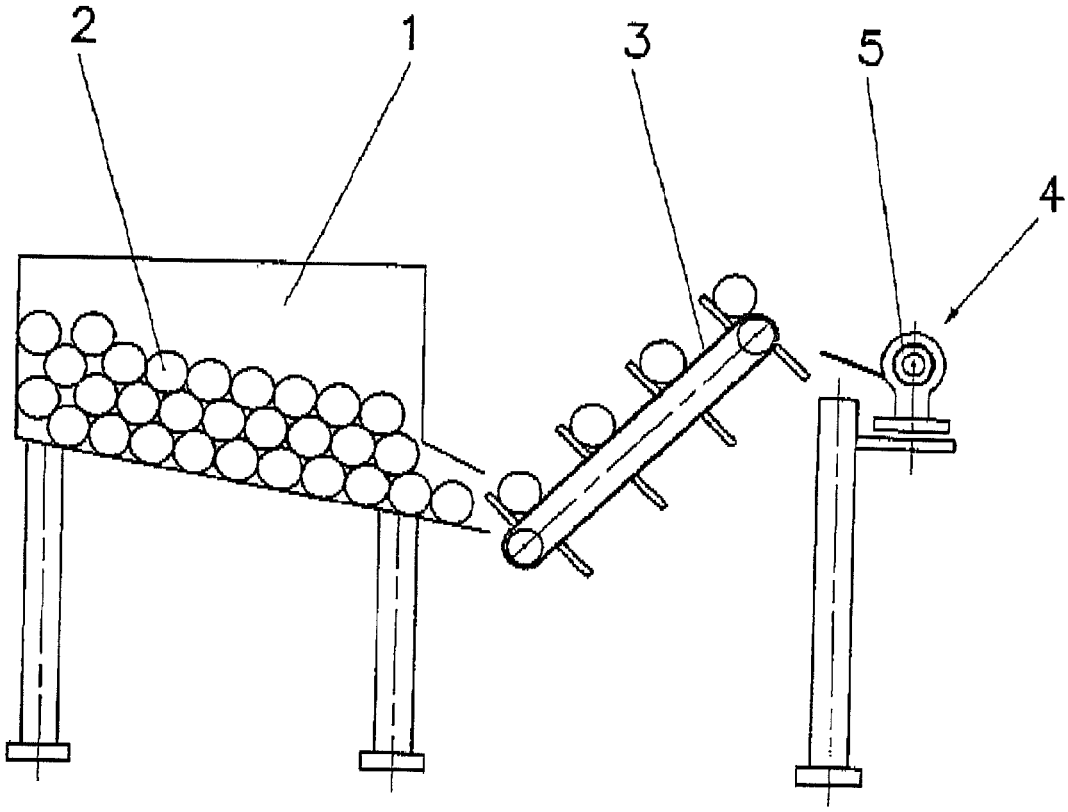
FIG. 1 illustrates a schematic side view of a storage container, a conveyer belt and a floating supporting winding shaft.

In a storage container 1, for example a magazine 1, large numbers of empty winding sleeves 2 are stacked such that the axes of rotation are parallel to the winding shaft 5. An endless conveyer belt 3, equipped with webs fastened transverse to its belt travel direction, successively grasps winding sleeves 2 from the magazine 1 and brings them into coaxial position toward the respective winding shaft 5. In this process the winding shaft 5 is floating at its free end 6, i.e., without support there, as is shown in FIG. 1.

Figure 2:
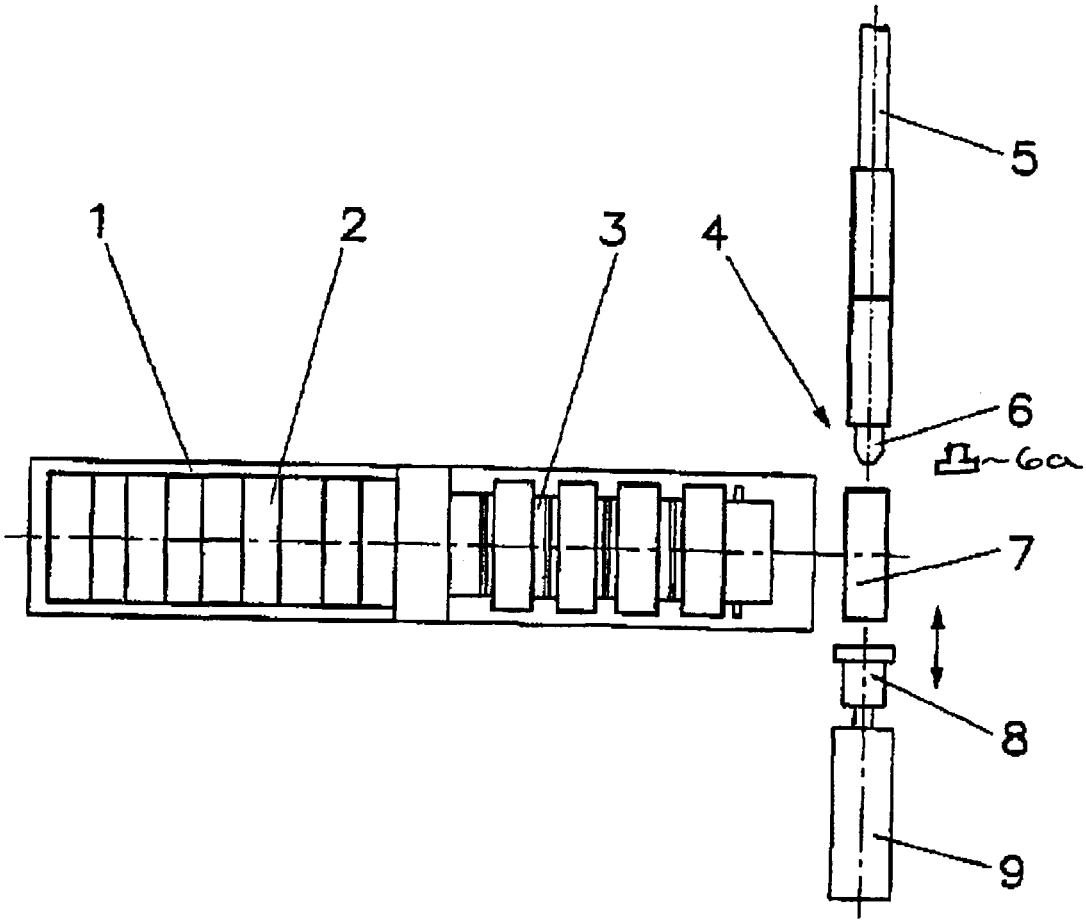
FIG. 2 is a top view of a storage container, a conveyer belt, an end of a floating supporting winding shaft and a sliding device.

FIG. 2 shows a top view of the magazine 1, the conveyer belt 3, a winding shaft 5 and a sliding device 8 with a pneumatic cylinder 9. The empty winding sleeve 7 provided for filling-on is now directly adjacent to the free end of the winding shaft 5 in a coaxial position. It is noted that before the winding shaft 5 is filled with empty sleeves, a support bearing 6*a* is removed from the winding shaft 5 and the support bearing is returned to the winding shaft 5 after filling. The sliding device 8, for example a pneumatic cylinder or an electrically driven linear drive, now slides the winding sleeve 7 onto the winding shaft 5 and immediately withdraws again. Now the delivery belt advances the next winding sleeves 7 from the conveyer belt 3 into a coaxial position to the winding shaft 5. The sliding device 8 now presses this sleeve 7 onto the winding shaft 5. In this process the previously introduced sleeve 7 is slid forward by one sleeve length by the next one. These processes repeat according to the program that has been input until the required number of empty sleeves is located on the respective winding shaft 5.

Now the magazine 1 and the transport device 3 can be withdrawn from the winding area. Thus the first working step, the sliding of the necessary winding sleeves 2, 7 onto the winding shaft 5, is complete.

Figure 3:
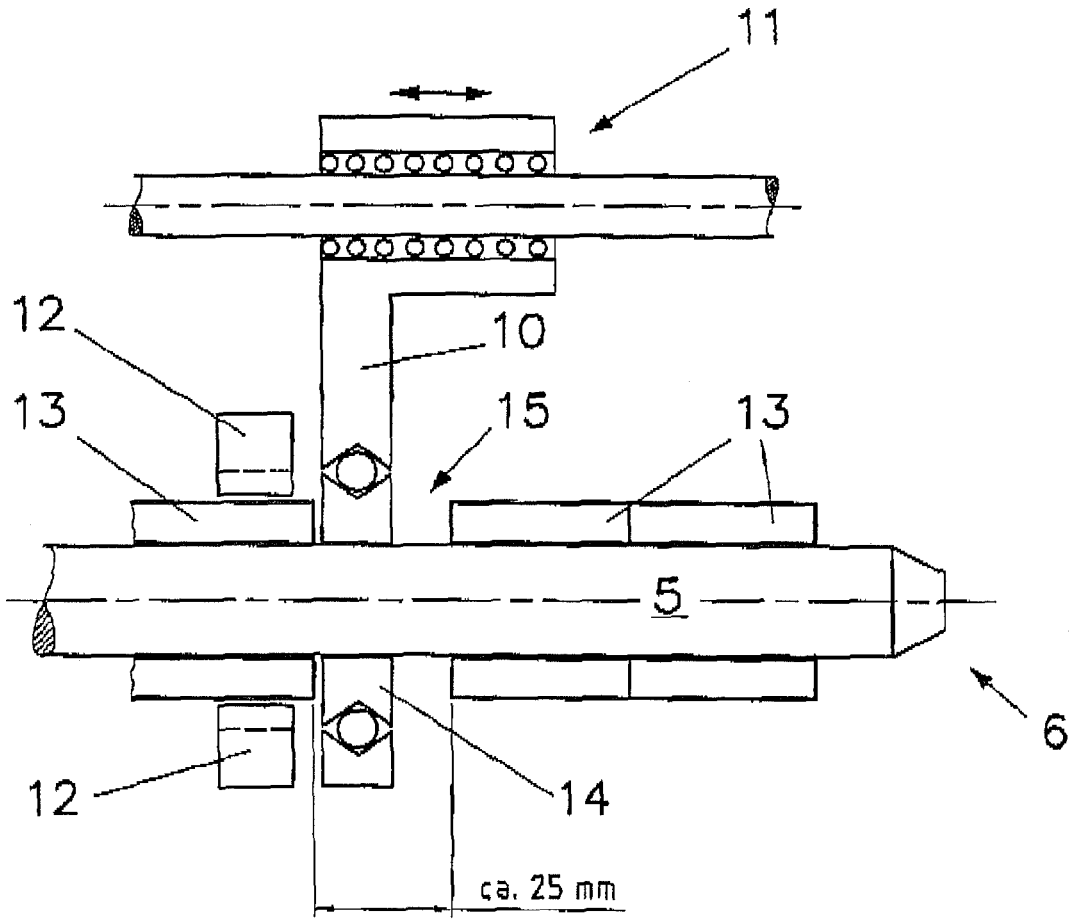
FIG. 3 illustrates a schematic section through a draw-off plate, a fork piece, tongs and winding sleeves on a winding shaft.

In a second working step, the sleeves 7 are positioned on the winding shafts 5. For this purpose a respective draw-off plate 10 is used for a dual function in that by means of tongs 12 that interact with the outer circumference of an empty sleeve 7 and move it along, a gap 15 forms between the adjacent sleeves 7, into which a fork piece 14 dips and thus assumes the precise positioning as shown in FIG. 3.

The plates 10 are supported and conveyed in guides 11 that travel transverse to the belt direction, i.e., axially to the winding shaft 5. The guides are mostly attached above the upper winding shaft 5 and below the lower one. In addition, these guides are supplemented by a motor drive for the draw-off plate 10.

To save money on devices for winding sleeve positioning in accordance with the invention, the draw-off plates 10 are also advantageously used according to the invention for positioning the empty sleeves 2, 7, 13.

Figure 5:
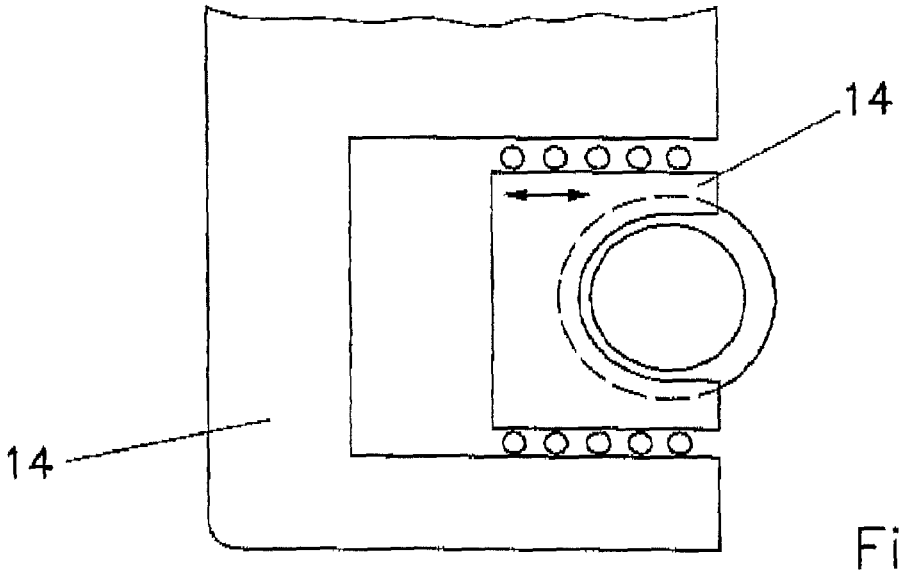
FIG. 5 illustrates a section through a winding shaft with winding sleeve and a top view of a fork piece that is movably supported in the draw-off plate.

The guidance and the drive work together with one measurement component and one computer program. The draw-off plates 10 are additionally equipped with tongs 12 for positioning the empty sleeves 13 already on the winding shafts. With the tongs, the empty sleeves 13 can be grasped on their outer circumference. In addition the horseshoe-shaped push-off piece 14 that surrounds the winding shaft 5 can be withdrawn radially from the respective winding sleeve 5 to a point where it can travel past the empty sleeves without making contact, as is shown in FIG. 5. For positioning the sleeves 13, the modified draw-off plates 10 operate in the opposite way from that for pushing off the winding rolls 7.

Figure 4:
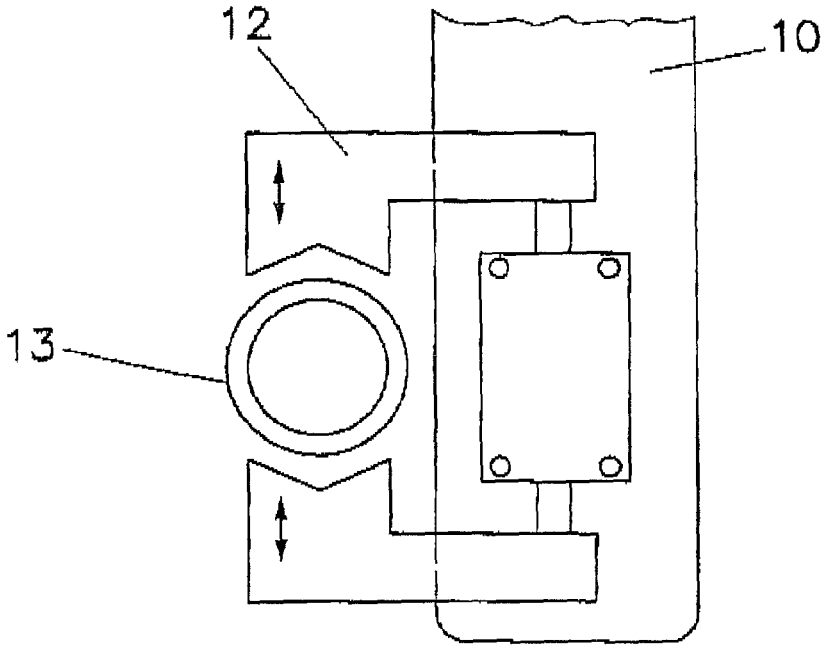
FIG. 4 illustrates a section through a winding shaft and a top view of tongs fastened to the draw-off plate.

The draw-off plate 10 travels with the open tongs 12 and withdrawn horseshoe-shaped push-off piece 14 over the first winding sleeve 13 that has been slid up. The tongs 12 close and grasp the first sleeve 13. Now the plate 10 moves together with this sleeve 13 in the direction of the parking and winding position, but only to the point where a gap 15 forms between the first empty sleeve and the second empty sleeve. This gap 15 is somewhat broader than the horseshoe-shaped push-off piece 14, thus about 25 mm. In this gap 15 the horseshoe-shaped push-off piece 14 now dips and the tongs 12 open as shown in FIG. 4.

Alternatively, at the beginning of positioning with the sleeve 13 first slid in, the positioning of the sleeve 13 slid on most recently is started. Then the horseshoe-shaped push-off piece 14 grasps the free front end of the last sleeve 13 and slides it with the entire column of winding sleeves 13 to the first position. Then the next-to-last sleeve 13 is grasped with the tongs 12 and, as described above, a gap 15 is created between the last and next-to-the-last sleeves 13. Here also the remaining sleeve column is advanced. The process is continued until the first sleeve that was slid on is reached. This order is advantageous for refilling, since the empty trips of the draw-off plate 10 are reduced to a minimum.

The positioning on the front end of the winding sleeves 2, 7, 13 is an essential component of the invention. The horseshoe-shaped or fork-shaped push-off piece 14, in the case of further travel movement of the respective plate 10, pushes itself against a front end of the winding sleeve 2, 7, 13 to be positioned. Then the desired position is reached over the previously entered program. The process is repeated stepwise until all of the winding sleeves 2, 7, 13 located on the respective winding shaft 5 have reached the required position.

The movement over the push-off piece 14 and the end face of the sleeves 2, 7, 13 is important in that all winding sleeves 2, 7, 13, which generally are made of cardboard, have unavoidable length tolerances. It is ensured with the process in accordance with the invention that all winding sleeves on a winding shaft correspond on one side to an exact, coinciding position with a cut edge of the strips to be wound. After the last positioning trip, the respective draw-off plate 10 moves into its parked position on the drive side. After winding is complete, the plates 10 first act again as pushers 10 for finished winding rolls and then once again as positioners for the empty winding sleeves 2, 7, 13.

The performance in terms and positioning accuracy and under consideration of the minimal engineering effort is an essential advantage of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for automated filling of a roll cutting and winding machine, the method comprising:

in a first step, sliding at least two empty winding sleeves onto a free end of a winding shaft so that the winding sleeves are adjacent to one another on said winding shaft;

in a second step, grasping the slid on first winding sleeve with tongs that are freely positionable along the winding shaft and slid over the winding shaft until a gap forms between adjacent winding sleeves; and in a third step, positioning a fork piece of a freely programmable draw-off plate into said gap between said adjacent winding sleeves generated by the tongs and positioning the first winding sleeve with the aid of said fork piece at the front end along the winding shaft.

2. The method according to claim 1, wherein the steps are repeated with additional empty winding sleeves until all desired winding sleeves are positioned on the winding shaft.

3. The method according to claim 1, wherein before filling the winding shaft with empty sleeves, a support bearing is removed from the winding shaft and the support bearing is returned to the winding shaft after filling.

4. The method according to claim 1, wherein the winding sleeves coming from a magazine are automatically and coaxially supplied and are automatically slid onto the winding shaft.

5. The method according to claim 1, wherein the winding sleeves are slid onto the winding shaft with the aid of a pneumatically driven cylinder.

6. A method for automated filling of a roll slitting and winding machine, the method comprising:

in a first step, sliding at least two empty winding sleeves onto a free end of a winding shaft so that the winding sleeves are adjacent to one another on said winding shaft;

in a second step, sliding the last winding sleeve by a fork piece of a freely programmable press-off plate that is freely positioned along the winding shaft at a free front end of the winding sleeve over the winding shaft until the last winding sleeve has reached a predetermined position;

in a third step, grasping the next-to-last winding sleeve by tongs that are freely positionable along the winding shaft and slid over the winding shaft until a gap forms between adjacent winding sleeves; and in a fourth step, positioning the fork piece into the gap produced by the tongs and at the free front end of the winding sleeve positions the next-to-last winding sleeve by the fork piece along the winding shaft.

7. The method according to claim 6, wherein the steps are repeated with the additional empty winding sleeves until all desired winding sleeves are positioned on the winding shaft.

* * * * *